US011371247B2

(12) United States Patent
Fahle

(10) Patent No.: US 11,371,247 B2
(45) Date of Patent: Jun. 28, 2022

(54) PANELS, MOUNTING CLAMPS AND WALL OR CEILING COVERING FOR A 3-DIMENSIONAL PATTERN OF WALL- AND CEILING PANELS

(71) Applicant: Xylo Technologies AG, Niederteufen (CH)

(72) Inventor: Daniel Fahle, Dresden (DE)

(73) Assignee: Xylo Technologies AG, Niederteufen (CH)

( * ) Notice: Subject to any disclaimer, the term of this patent is extended or adjusted under 35 U.S.C. 154(b) by 0 days.

(21) Appl. No.: 16/470,086

(22) PCT Filed: Dec. 20, 2016

(86) PCT No.: PCT/EP2016/081823
§ 371 (c)(1),
(2) Date: Jun. 14, 2019

(87) PCT Pub. No.: WO2018/113908
PCT Pub. Date: Jun. 28, 2018

(65) Prior Publication Data
US 2020/0018076 A1 Jan. 16, 2020

(51) Int. Cl.
*E04F 13/08* (2006.01)
*E04F 13/10* (2006.01)

(52) U.S. Cl.
CPC ..... *E04F 13/0826* (2013.01); *E04F 13/0844* (2013.01); *E04F 13/085* (2013.01); (Continued)

(58) Field of Classification Search
CPC ..... E04B 9/04; E04B 9/22; E04B 9/30; E04B 9/34; E04B 13/08; E04B 13/0828; (Continued)

(56) References Cited

U.S. PATENT DOCUMENTS 2,110,729 A * 3/1938 Hoggatt ..... E04F 13/10 52/448
2,706,838 A 4/1955 Sears
(Continued)

FOREIGN PATENT DOCUMENTS

AU 27970/71 A 10/1972
DE 102 55 204 B3 7/2004
(Continued)

OTHER PUBLICATIONS

Written Opinion of the International Searching Authority and International Search Report, issued in International Application No. PCT/EP2016/081823, dated Sep. 12, 2017, European Patent Office, Rijswijk, Netherlands.

*Primary Examiner* — Jessica L Laux
(74) *Attorney, Agent, or Firm* — Crowell & Moring LLP

(57) ABSTRACT

A rectangular or square wall- or ceiling panel is provided, comprising a first profile a first profile on two opposing edges, whereby each such first profile consists of a panel groove, an inner leg on an installation side of a panel and an outer leg on an visible side of a panel, both inner leg and an outer leg confining said panel groove, wherein both said outer legs are longer than said inner legs. A further second profile may be provided on at least one of the other two opposing edges of the panel, said at least one second profile consisting of a recess on the installation side of the panel. The visible side may be a decorative side.

5 Claims, 4 Drawing Sheets

(52) U.S. Cl.
CPC ..... *E04F 13/0864* (2013.01); *E04F 13/0894* (2013.01); *E04F 13/10* (2013.01)

(58) Field of Classification Search
CPC ..... E04B 13/0871; E04B 13/24; E04B 13/26; E04B 13/28; E04B 13/10; E04B 13/0864; E04B 13/0862; E04B 13/0892; E04B 13/0894; E04B 13/0826; E04B 13/0841; E04B 13/0844; E04B 13/085
See application file for complete search history.

(56) References Cited

U.S. PATENT DOCUMENTS

| | | | | |
|---|---|---|---|---|
| 2,831,222 | A * | 4/1958 | Anderson | E04F 13/0826 52/489.1 |
| 7,010,894 | B1 * | 3/2006 | Cappelle | E04B 9/26 52/384 |
| D606,850 | S * | 12/2009 | Boyd | D8/395 |
| 7,726,083 | B2 * | 6/2010 | Wagner | E04F 13/0812 52/235 |
| 9,695,597 | B2 * | 7/2017 | Wagner | E04F 13/0805 |
| 10,428,532 | B2 * | 10/2019 | Smart | E04F 13/0894 |

FOREIGN PATENT DOCUMENTS

| | | |
|---|---|---|
| DE | 20 2012 100 659 U1 | 5/2012 |
| DE | 10 2007 063 646 B4 | 6/2015 |
| DE | 10 2007 007 620 B4 | 4/2016 |
| EP | 0 621 383 B1 | 6/1997 |
| GB | 1079072 | 8/1967 |

* cited by examiner

PANELS, MOUNTING CLAMPS AND WALL OR CEILING COVERING FOR A 3-DIMENSIONAL PATTERN OF WALL- AND CEILING PANELS

TECHNICAL FIELD

The present invention relates to panels, mounting clamps, a mounting system and a mounting method for wall- and ceiling panels in order to produce a novel and interesting 3-D effect. The panels can be made of nearly any material, including wood based material such as wood, wood veneer. HDF and MDF laminate, chip boards, Oriented Strand Boards (OSB) and the like, and also from plastic such as PVC, or cement fiber boards, gypsum, metal, glass, ceramics or any other material. The 3-D effect not only relates to the panels being mounted in three different planes and thus generating different shadow lines, but also relates to the effect of certain panels seeming to have different lengths, different widths and different surface areas than other panels.

The invention also relates to a mounting system with clamps which enable the panels to be easily and quickly mounted in order to achieve the desired 3-D effect and a mounting method therefore.

PRIOR ART

Mounting wall- or ceiling panels in different planes in order to produce an interesting 3-D effect is generally known in the art. It is also known that tongue- and groove systems on the sides of panels can facilitate means to shift panels into different mounting planes and then hold them there.

EP 0 621 383 discloses a ventilated wainscoting for a wall with two different types of panels. One type of these panels can be mounted in a second plane which is facing further away from the wall than those panels in the first plane. Only the panels which can be mounted in the second plane have a single enlarged "front groove string" which laterally extends further outwards than the "rear groove string". The single enlarged front groove string serves as an aid to provisionally accommodate nails in order to mount a next row. Mounting panels in a third row is not disclosed.

DE 10 2007 063 646 discloses how a tongue and groove system with several tongues and grooves on a panel side can be used to generally produce a 3-D effect, as does DE2118499.

DE 10 2007 007 620 further teaches a similar arrangement wherein an additional spline is fitted into such a tongue and groove system.

U.S. Pat. No. 2,706,838 teaches to mount panels in different planes by joining them through simple tongue and groove (or "leg" and "groove") systems. U.S. Pat. No. 2,706,838 also teaches that thereby panels can be mounted in three (or even more) planes, thereby creating interesting esthetic effects such as step arrangements and shadow lines. U.S. Pat. No. 2,706,838 discloses equal lengths of the outer and the inner legs of the profiles such as in FIGS. 1, 4, 5, 7 and 11, with an exception to this shown in FIG. 3, where the inner legs of a panel are longer than its outer, shorter legs. The inner legs are made longer than the outer legs in order to be able to receive nails in the inner legs by which the panels are mounted.

Starting from the prior art, it is therefore the technical objection of the present invention to provide a wall or ceiling covering made of separate panels, which can be installed in a way that a 3D effect is given. This 3D effect gives the optical illusion that some of the panels of the wall or ceiling covering seem to be larger than the other panels, although for the wall or ceiling covering panels of the same type and size are used.

This technical objective is solved by the rectangular or square wall—or ceiling panel—according to claim 1, the mounting clamp for the installation of the rectangular or square wall—or ceiling panels—according to claim 5 as well as the wall or ceiling covering according to claim 14. The respective dependent claims relate to preferred embodiments.

SUMMARY OF THE INVENTION

The invention refers in a first aspect to rectangular or square wall- or ceiling panel, comprising a first profile a first profile on two opposing edges, whereby each such first profile consists of a panel groove, an inner leg on an installation side of a panel and an outer leg on an visible side of a panel, both inner leg and an outer leg confining said panel groove, characterized in that both said outer legs are longer than said inner legs.

In a preferred embodiment a further second profile is provided on at least one of the other two opposing edges of the panel according to the invention, said at least one second profile consisting of a recess on the installation side of the panel.

Preferably the second profile is provided on both of the other two opposing edges.

The visible side can be decorative side. The decorative side e.g. can be covered with a paint coating or varnish, furthermore, the decorative side can be made of veneer or made of any laminate. The decorative side can be structured or plain.

In another preferred embodiment the panel is beveled on at least one edge, preferably on both opposing edges where the first profile is provided and/or on both opposing edges where the second profile is provided.

In a second aspect, the present invention refers to a mounting clamp, comprising a foot to accommodate mounting means and a mounting hook, said mounting hook extending from the foot and said mounting hook being shaped to form a first and a second clamp groove, wherein the first clamp groove being adapted to receive the first leg of a rectangular or square wall- or ceiling panel according to the invention in a first installation plane and the second clamp groove being adapted to receive the first leg of a rectangular or square wall- or ceiling panel according to any of the invention in a second installation plane.

The mounting clamps therefore comprise different possibilities for the installation of panels according to the present invention. The first installation plane is the closest plane to the foot of the mounting clamp. If panels are installed to the first clamp groove, which resembles the first installation plane, therefore, the panels can be installed closest to the wall or ceiling, respectively.

If the panels are received by the second clamp groove, the panels can be installed in a second plane, which is, compared to the first installation plane, further away from the wall or ceiling, respectively.

The panels according to the present invention also can be installed in a third installation plane. In order to do so, the first legs of panels according to the invention are received by the panel groove of panels which already have been installed in the second installation plane. The third installation plane is, compared with the first and second installation planes, respectively, furthest from the wall or ceiling, respectively.

The mounting clamp can be attached to the wall or ceiling, respectively by means of the foot.

The mounting clamp therefore enables to install the panels according to the present invention in three different planes, therefore generating the above-referenced optical 3D effect.

In a preferred embodiment the first and a second clamp groove are aligned on opposite sides of the mounting hook. This enables that with a mounting clamp according to the invention two different panels on different sides of the clamp can be installed at the same time.

In a further specific embodiment, the mounting hook comprises a first leg which extends perpendicular or approximately perpendicular from the foot, a second leg which is aligned perpendicular or approximately perpendicular to the first leg thereby forming the first clamp groove between the second leg and the foot, a third leg which is aligned perpendicular or approximately perpendicular to the second leg and extending away from the foot, as well as a forth leg which is aligned perpendicular or approximately perpendicular to the third leg and extending in a direction so that the forth leg is superposed with the second leg thereby forming the second clamp groove between the forth leg and the second leg, said forth leg comprising the fixation means. This fixation means can interlock or engage (such as e.g. intrude into the material of a installed panel) with the panel and therefore allow a secure installation of the panels.

Furthermore, it is preferred if the mounting hook comprises a first leg which extends perpendicular or approximately perpendicular from the foot, a second leg which is aligned perpendicular or approximately perpendicular to the first leg thereby forming the first clamp groove between the second leg and the foot, a third leg which is aligned perpendicular or approximately perpendicular to the second leg and extending away from the foot, as well as a forth leg which is aligned perpendicular or approximately perpendicular to the third leg and extending in a direction so that the forth leg is superposed with the second leg thereby forming the second clamp groove between the forth leg and the second leg, said forth leg comprising the fixation means.

Especially, the fourth leg is longer than the second leg.

The fixation means can be sharpened etc. In this respect, if a fixation means has e.g. the form of an edge nail, which allows an easy intrusion into the panel so that a secure installation is possible.

According to an additional preferred embodiment, the foot comprises at least one, preferably a plurality of mounting holes. In a preferred embodiment, the foot has a U-shaped profile and the mounting hook is formed by punching and cold forming.

The mounting clamp preferably is formed integrally with the mounting hook.

This enables for an easy production of the mounting clamp which e.g. can be produced from rectangular metal sheets by e.g. punching and coat forming. In a general special embodiment, the foot of the mounting clamp has a U-shaped profile.

According to a third aspect, the present invention refers to wall or ceiling covering, made of a plurality of rectangular or square wall- or ceiling panels according to the present invention which are installed to the wall or the ceiling, respectively, by means of a plurality of mounting clamps according to the present invention, wherein each of the panels is installed by means of at least two mounting clamps, wherein at least one mounting clamp being aligned on one side and at least one mounting clamp being aligned on the opposing side of each panel where the first profile is present, wherein a panel is installed in a first installation plane by receipt of the inner leg panel in the first clamp groove of the respective mounting clamps used for the installation of the respective panel, or in a second installation plane by receipt of the inner leg panel in the second clamp groove of the respective mounting clamps used for the installation of the respective panel, or in a third installation plane by receipt of both inner legs of a panel by the panel grooves of at least two further panels, said further panels being installed in the second installation plane.

The mounting clamps can be installed directly to the wall or ceiling, respectively, or indirectly by means of mounting slates.

In a further preferred embodiment, the mounting clamps are installed to the wall or ceiling, respectively, by means of clamp mounting means, such as e.g. nails, screws, bolts.

The present invention aims to mount a plurality of wall- and/or ceiling panels so that an interesting and pleasant three-dimensional effect is created. In order to create this effect, the panels are mounted in at least three different planes which are in parallel to the wall or ceiling.

By the mounting in these three different planes, interesting step arrangements and shadow lines are created as are known in the art. In order to further enhance this effect, a special panel geometry and panel mounting means are disclosed. The panel geometry is chosen in such a way, that panels which are mounted in a third, outermost plane additionally seem larger than the panels lying in a lower plane. In this way, not only complete rows, but also additionally single panels contribute to the three-dimensional effect.

This is achieved by having the panels in the third plane overlap panels in the second or in the first planes This overlapping again is achieved by panels with a profile on two of its opposed sides consisting of a groove with two legs, the outer leg being longer than the inner leg. The effect can then be further enhanced by implementing a recess on the inner side of the other two sides of a panel, so that then a panel mounted in a third plane overlaps all panels of lower planes on all four of its sides.

Furthermore a mounting clamp with a generally S-shaped profile on a foot is disclosed which allows for fast and easy mounting of the panels according to the invention.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings, FIG. 1 Shows a front view on an (unfinished) wall- or ceiling covering with panels according to the invention.

DESCRIPTION OF PREFERRED EMBODIMENTS

Figure 1:
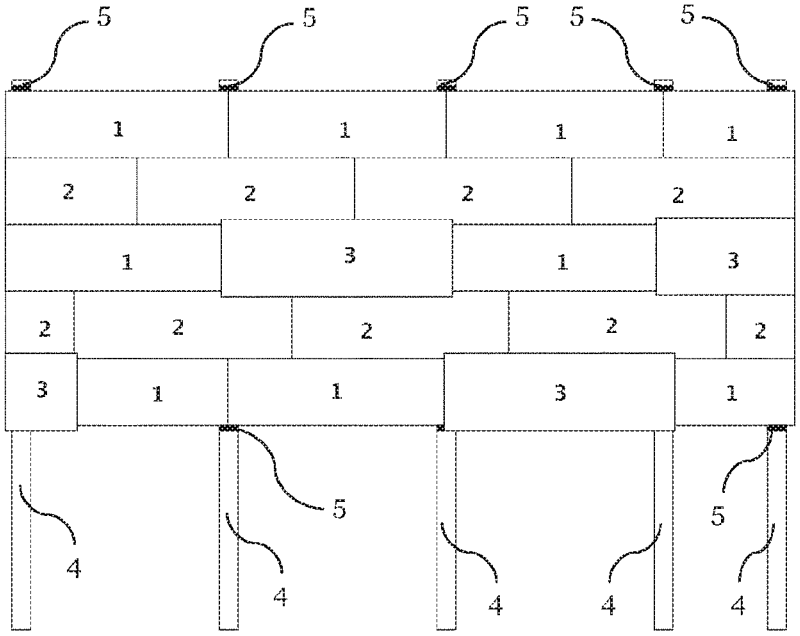

FIG. 1 shows a front view on an (unfinished) wall- or ceiling covering with panels according to the invention. While the panels according to the invention may be mounted directly onto a wall or to a ceiling, mounting the panels onto previously installed slates 4—such as two-by-fours known in the art—is preferred as this allows for easier mounting, better insulation and better venting.

In the example of FIG. 1, a first row of panels is mounted completely in a first plane 1. While it would also be possible to begin mounting with variations of different planes in the first and/or also in the second row, it is preferable to mount the whole first row in the first plane 1 and the whole second row in the second plane 2 for reasons of stability since then the full length of the profile will contribute to the stability of the panels.

For reasons of economy, all panels delivered from the factory initially have the same size. In order to finish a row or in order to create an offset pattern in a next row however, the user or installer of a wall- or ceiling covering may cut specific panels into a necessary or desired length. He may also cut the panels to necessary or desired width in the first or the last row to be mounted if only a fraction of the width of a panel is necessary to fill the desired surface.

FIG. 1 further shows the general positions of mounting clamps (5) when they are not covered by other panels.

Most importantly however, FIG. 1 shows the effect in which panels mounted in a third plane 3 appear to be both wider and longer than panels mounted in the first 1 and second planes 2 due to their overlapping edges, even though all panels essentially are of the same size; except of course those end-panels which have been shortened by the user or installer.

Figure 2:
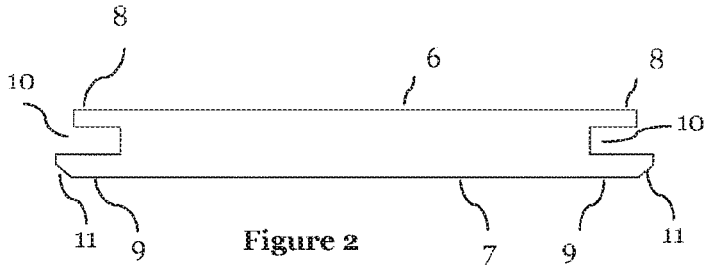
FIG. 2 Shows the cross section of a panel according to the invention.

FIG. 2 shows a cross section of a panel according to the invention with an inner side 6 (the installation side which will not be visible when the panel is installed) which is closest to the wall or ceiling where the panel is mounted. Reference numeral 7 refers to the outer side (i.e. the visible side when the panel is installed) of the panel, reference numeral 8 refers to the inner leg of the profile on the panel, reference numeral 9 refers to the outer leg of the profile on the panel, reference numeral 10 refers to a groove in the panel which is located between the inner leg 8 of the profile and the outer leg 9 of the profile; reference numeral 11 refers to an optional bevel in a preferred embodiment.

Most panels according to the invention have a generally rectangular shape with the mounting profile consisting of the inner leg 8, the groove 10 and the outer leg 9 being located at the long side of the panel. However, variants with square-shaped panels and with rectangular panels which have the mounting profile located on their short sides are also part of the present invention.

As shown in FIG. 2, it is essential that the outer leg 9 of the panel is longer than the inner leg 8 in order to obtain the overlapping and the 3-D effect shown in FIG. 1.

Figure 3:
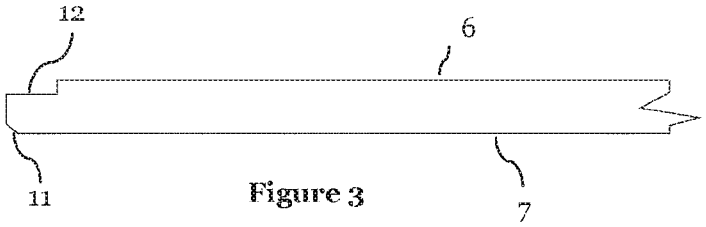
FIG. 3 Shows the end of a panel according to the invention with a profiled recess on its short side.

FIG. 3 shows the profile of a panel according to the invention at those two edges which are located on the sides of the panel which are perpendicular to the sides with the mounting profiles, which normally are the short sides of the panel. The recess 12 enables a panel mounted in the third plane 3 to overlap a panel mounted in a first plane 1, thus further enhancing the effect of seemingly enlarged panels in the third plane 3. As in FIG. 2, an optional bevel 11 can be added on these short sides in preferred embodiments.

Figure 4:
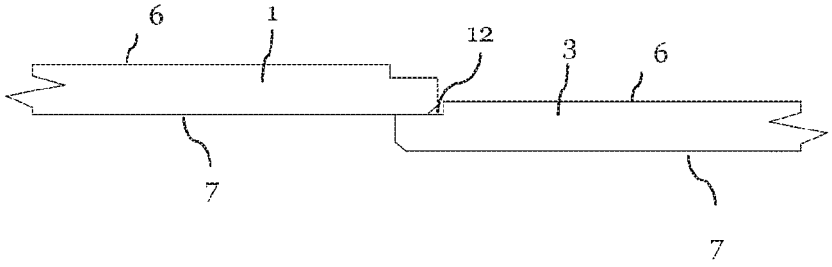
FIG. 4 Shows the employment of a recess on the short side of a panel according to the invention.

FIG. 4 further illustrates the use of the recess 12 so a panel mounted in the third plane 3 overlaps a panel mounted in a first plane 1.

Figure 5:
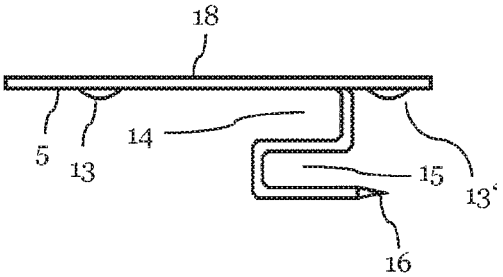
FIG. 5 Shows a cross section of an embodiment of a mounting clamp according to the invention.

FIG. 5 shows a cross section of an embodiment of a mounting clamp 5 according to the invention. Such a mounting clamp 5 can be made of any material such as metal or plastic, but is preferably made of bent and punched sheet steel. Said mounting clamp 5 consists of a foot 18 which accommodates a variety of mounting holes 17 through which screws, staples, dowels, pegs, nails or other mounting means 13 may be inserted. The generally "S"-shaped hook of clamp 5 further comprises of a first groove (14) and a second groove 15, as well as a fixation means 16.

A panel according to the present invention can be mounted to the mounting clamp 5 by insertion of the inner leg 8 of a panel into the first groove 14 of the mounting clamp. If a panel is installed into groove 14 in this way, the panel will be installed into the first installation plane 1.

Additionally or alternatively, the panel can also be installed into the second clamp groove 15 by insertion of the inner leg 8 into groove 15, so that in this case the panel will be installed into the second installation plane 2.

If a panel is intended to be installed in the third installation plane 3, the inner leg 8 of a panel is inserted into the panel groove of a panel which has been installed in the third installation plane.

Each clamp simultaneously allows installation of two panels, due to the S-shaped profile of the hook of clamp 5.

The S-shaped profile is defined by separate legs of the mounting hook. As especially visible in FIG. 5, the first leg extends downwards from the foot 18 of the mounting clamp. The second leg of the hook leads to the left, beginning from the end of the first leg. The third leg moves downwardly from the end of the second leg whereas the fourth leg again leads to the right end finishes with the fixation means 16.

In a preferred embodiment, the clamp 5 further comprises one or more tips at one end of the "S" which can serve as clamp fixation means 16. These clamp fixation means 16 prevent the inner leg 8 of panels mounted in a second plane 2 from slipping out of the first clamp groove 14 when being mounted as shown by 5' in FIG. 7.

Clamps 5 made from bent and folded sheet steel have proven to be exceptionally useful, since when they are employed as shown in FIGS. 7 to 10, the "S" shape cannot be stretched since the inserted legs of the panel profiles prevent the steel from being bent back.

Figure 6:
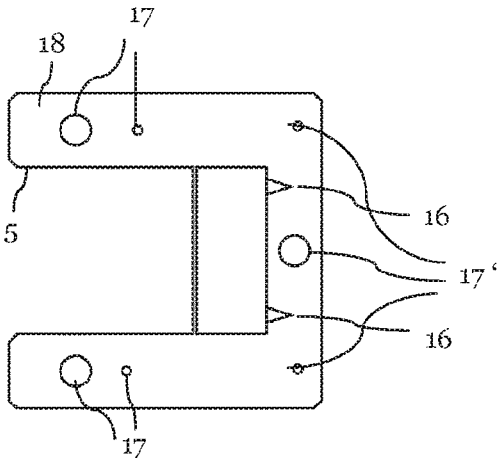
FIG. 6 Shows a top view of an embodiment of a mounting clamp according to the invention.

FIG. 6 shows a top view of the same embodiment of a mounting clamp 5 according to the invention. As can be seen in FIG. 5, it is possible to access the mounting means 13' with a mounting tool such as a screw driver, a hammer or the like, even if a panel has been mounted in the first groove 14.

Correspondingly, as can also be seen in FIG. 5, it is also possible to insert mounting means 13 into the mounting holes 17' if a panel has been mounted in the second groove 15. This is necessary when a second clamp 5' is mounted to a panel already inserted into a first clamp 5 as shown below in FIGS. 7 to 10. In this way, only one type of clamp is needed to mount any panel. The clamps are designed in such a manner that it is sufficient to attach them by employing mounting means 13 or 13' only on one side of the "S"-shaped profile.

Figure 7:
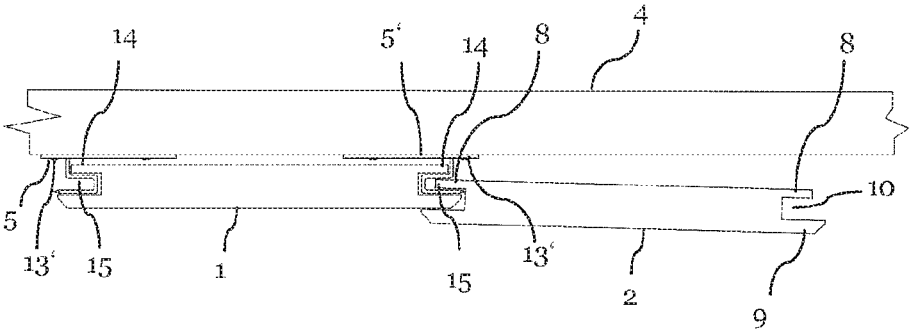
FIG. 7 Shows a cross section of the mounting of a first and second panel according to the invention in a first and in a second plane.

FIG. 7 shows a cross section of the mounting of a first panel in a first plane 1 and the provisional addition of a second panel in a second plane 2.

The first groove 14 of the clamp 5' is dimensioned in such a way that the inner leg 8 of a panel in a first plane 1 can be fitted into it when the clamp is mounted to either the wall or the ceiling or to mounting slates. The second groove 15 is dimensioned in such a way that the inner leg 8 of a panel in a second plane 2 can be fitted into it. The groove 10 of a panel is dimensioned in such a way that the clamp 5 surrounding the inner leg 8 of a panel may be fitted into it. The groove 10 of a panel is further dimensioned in such a way that both the clamp 5 and the outer leg 9 simultaneously fit into it. FIG. 7 also shows that a second clamp 5' can be mounted in a mirrored position to a first clamp 5. It is sufficient to mount the clamps 5 and 5' in FIG. 7 by mounting means 13' alone.

Figure 8:
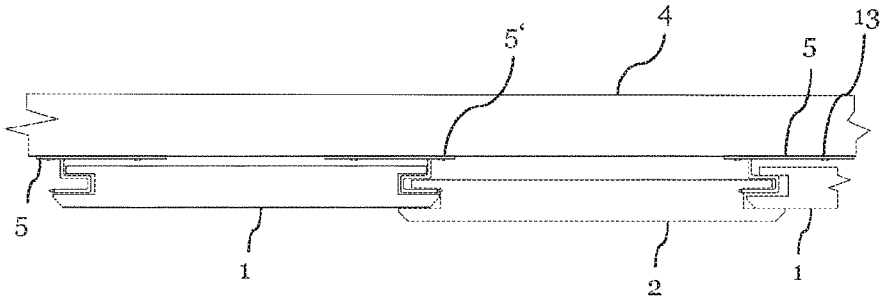
FIG. 8 Shows a cross section of two panels according to the invention mounted in a first plane and of a third panel mounted in a second plane.

FIG. 8 shows a cross section of two panels according to the invention mounted in a first plane 1 and of a third panel mounted in a second plane 2. Here the third clamp 5 may me mounted by mounting means 13 alone.

Figure 9:
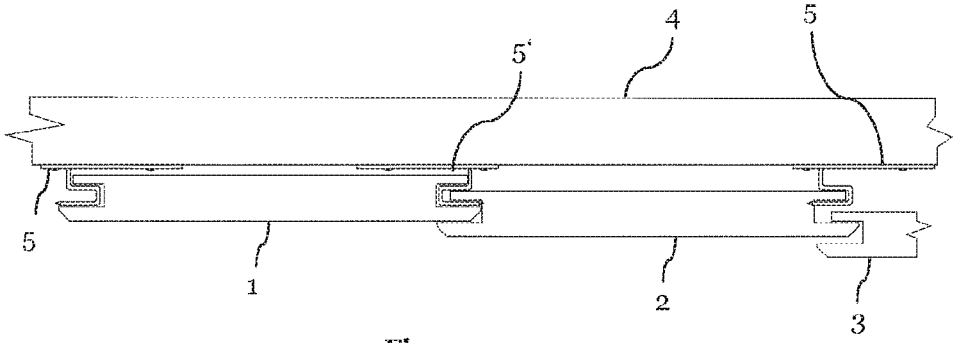
FIG. 9 Shows a cross section of the mounting of a first panel according to the invention in a first plane, a second panel in a second plane and a third panel in a third plane.

FIG. 9 shows a cross section of a panel according to the invention mounted in a first plane 1, of a second panel mounted in a second plane 2 and of a third panel mounted in a third plane 3. Panels mounted in a third plane 3 are not directly attached by a clamp 5, 5' but rather are held into their position by the legs 8, 9 and the groves 10 of the profile.

Figure 10:
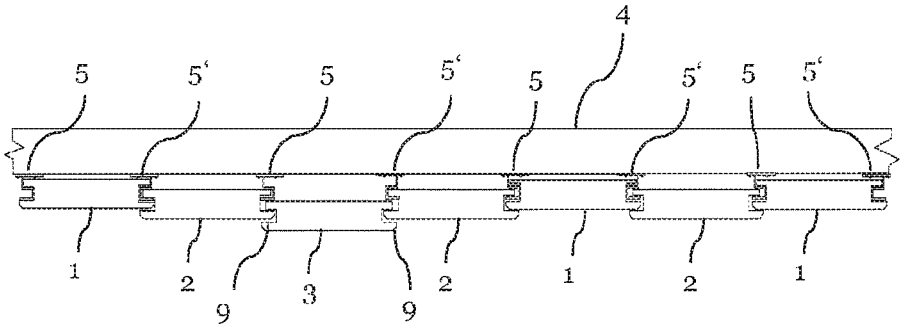
FIG. 10 Shows a cross section of a possible variation of mounting the panels according to the invention in first, second and third planes.

FIG. 10 shows a cross section of a possible variation of mounting the panels according to the invention in a first plane 1, a second plane 2 and a third plane 3. FIG. 10 also demonstrates that when a panel in the third plane 3 is looked at e.g. from below, it appears to be broader than the panels in the second plane 2 or the in first plane 1, as both of its outer legs 9 are not overlapped by any other panels.

LIST OF REFERENCE SIGNS

1 Panel mounted in first installation plane
2 Panel mounted in second installation plane
3 Panel mounted in third installation plane
4 Mounting slates
5, 5' Mounting clamp
6 Installation side of panel
7 Visible side of panel
8 Inner leg
9 Outer leg
10 Panel groove
11 Bevel
12 Recess
13, 13' Clamp mounting means
14 First clamp groove
15 Second clamp groove
16 Clamp fixation means
17, 17' Clamp mounting holes
18 Clamp foot

The invention claimed is:

1. A rectangular or square wall- or ceiling panel, comprising:

an installation side having a planar installation surface, a first profile on two opposing edges and a second profile on the other two opposing edges of the wall- or ceiling panel, wherein each such first profile consists of a panel groove, an inner leg on the planar installation surface of the wall- or ceiling panel and an outer leg on a visible side of the wall- or ceiling panel, both the inner leg and the outer leg confining said panel groove, wherein both said outer legs are longer than said inner legs, wherein each such second profile consists of a recess on the installation surface of the wall- or ceiling panel, wherein the planar installation surface terminates at a first edge of the recess, the recess extending into the wall- or ceiling panel from the planar installation surface, the recess terminating at a second edge of the recess, the second edge of the recess on at least one of the other two opposing edges.

2. The panel of claim 1, wherein the visible side is a decorative side.

3. The panel of claim 1, wherein the panel is beveled on at least one edge.

4. The panel of claim 1, wherein the panel is beveled on both opposing edges comprising the first profile.

5. The panel of claim 1, wherein the panel is beveled on both opposing edges comprising the second profile.

* * * * *